US008616531B2

(12) United States Patent
Hough et al.

(10) Patent No.: US 8,616,531 B2
(45) Date of Patent: Dec. 31, 2013

(54) PIVOTING FENCING APPARATUS AND FENCING SYSTEM

(75) Inventors: Matthew Egan Hough, Long Branch, NJ (US); David Alan Benner, Honesdale, PA (US)

(73) Assignee: Purrfect Cat Fence, LLC, Honesdale, PA (US)

( * ) Notice: Subject to any disclaimer, the term of this patent is extended or adjusted under 35 U.S.C. 154(b) by 0 days.

(21) Appl. No.: 13/143,687

(22) PCT Filed: Jan. 7, 2010

(86) PCT No.: PCT/US2010/020326

§ 371 (c)(1),
(2), (4) Date: Jul. 7, 2011

(87) PCT Pub. No.: WO2010/080880

PCT Pub. Date: Jul. 15, 2010

(65) Prior Publication Data

US 2011/0272658 A1 Nov. 10, 2011

Related U.S. Application Data

(60) Provisional application No. 61/143,034, filed on Jan. 7, 2009.

(51) Int. Cl.
*E04H 17/00* (2006.01)

(52) U.S. Cl.
USPC ..... 256/11

(58) Field of Classification Search
USPC ..... 256/1, 3, 11, 12, 65.03, 65.05, DIG. 2
See application file for complete search history.

(56) References Cited

U.S. PATENT DOCUMENTS

| | | | |
|---|---|---|---|
| 243,696 | A | 7/1881 | Faloon |
| 249,803 | A | 11/1881 | Sparks |
| 257,847 | A | 5/1882 | Cheney |
| 903,258 | A | 11/1908 | Woodson |

(Continued)

FOREIGN PATENT DOCUMENTS

| | | | |
|---|---|---|---|
| DE | 19701770 | C2 | 11/2000 |
| JP | 2000356052 | A | 12/2000 |

(Continued)

OTHER PUBLICATIONS

Int'l Preliminary Report on Patentability issued Jul. 12, 2011 in Int'l Application No. PCT/US2010/020326.

(Continued)

*Primary Examiner* — Michael P Ferguson
*Assistant Examiner* — Daniel Wiley
(74) *Attorney, Agent, or Firm* — Panitch Schwarze Belisario & Nadel LLP

(57) ABSTRACT

A fencing apparatus for preventing animals from climbing over a fence, which includes a plurality of first and corresponding second elongated members, is provided. Each of the first and second elongated members pivot relative to each other from a first stationary position to a second variable position. A flexible plastic netting is connected to and extends across the plurality of first and second elongated members. When connected to a vertically extending fence, the fencing apparatus extends from the vertically extending fence such that the second elongated member pivots downwardly upon being subject to a load e.g., by the weight of a climbing animal.

17 Claims, 6 Drawing Sheets

(56) References Cited

U.S. PATENT DOCUMENTS

| | | | | | |
|---|---|---|---|---|---|
| 1,406,929 | A | * | 2/1922 | Butcher | 256/11 |
| 1,440,713 | A | * | 1/1923 | Ausbourne | 16/324 |
| 1,476,853 | A | | 12/1923 | Tabor | |
| 1,546,094 | A | * | 7/1925 | Marbaugh | 256/11 |
| 1,672,947 | A | * | 6/1928 | Lefforge | 256/11 |
| 1,673,613 | A | * | 6/1928 | Bach | 256/3 |
| 1,703,189 | A | * | 2/1929 | Getz | 256/11 |
| 1,704,167 | A | * | 3/1929 | Callane | 256/3 |
| 1,773,519 | A | * | 8/1930 | Cox | 256/11 |
| 1,839,898 | A | * | 1/1932 | Skinner | 256/11 |
| 1,859,509 | A | * | 5/1932 | Haverstick | 256/1 |
| 2,015,615 | A | | 9/1935 | Caplinger | |
| 2,119,808 | A | * | 6/1938 | Fecht | 482/16 |
| 2,161,944 | A | | 6/1939 | Bauer | |
| 2,199,518 | A | * | 5/1940 | Coleman | 256/35 |
| 2,720,673 | A | * | 10/1955 | Wise | 16/82 |
| 2,766,017 | A | | 10/1956 | Cote | |
| 3,028,147 | A | * | 4/1962 | Crumbo | 256/11 |
| 3,093,258 | A | * | 6/1963 | Turner | 217/60 E |
| 3,351,369 | A | * | 11/1967 | Hogstrom | 292/263 |
| 3,455,113 | A | * | 7/1969 | Dommann et al. | 405/288 |
| 3,478,714 | A | | 11/1969 | Keats | |
| 3,749,368 | A | * | 7/1973 | Miller | 256/11 |
| 3,771,767 | A | | 11/1973 | Dougherty | |
| 3,792,680 | A | * | 2/1974 | Allen | 116/173 |
| 3,796,410 | A | * | 3/1974 | Konstant | 256/1 |
| 3,806,095 | A | | 4/1974 | Ford | |
| 3,861,084 | A | | 1/1975 | Ford | |
| 4,032,248 | A | * | 6/1977 | Parduhn et al. | 404/10 |
| 4,065,103 | A | * | 12/1977 | Sweezey | 256/11 |
| 4,072,295 | A | * | 2/1978 | Roberts | 256/26 |
| 4,081,177 | A | | 3/1978 | Graff | |
| 4,301,996 | A | | 11/1981 | Holyoak | |
| 4,365,435 | A | * | 12/1982 | Snyder, Jr. | 40/608 |
| 4,366,949 | A | | 1/1983 | Staub, Sr. | |
| 4,533,906 | A | * | 8/1985 | Amir | 340/541 |
| 4,596,388 | A | * | 6/1986 | Burden | 482/16 |
| 4,603,840 | A | * | 8/1986 | Simkin | 256/11 |
| 4,610,432 | A | * | 9/1986 | Lewis et al. | 256/65.14 |
| 4,673,166 | A | | 6/1987 | MacDougall | |
| 4,674,145 | A | * | 6/1987 | Epple et al. | 15/250.19 |
| 4,916,433 | A | * | 4/1990 | ver Loren van Themaat | 340/550 |
| 4,949,490 | A | * | 8/1990 | Miller | 40/605 |
| 4,993,089 | A | * | 2/1991 | Solomon et al. | 5/430 |
| 5,143,354 | A | | 9/1992 | Nolan | |
| 5,267,724 | A | | 12/1993 | Heath et al. | |
| 5,299,781 | A | * | 4/1994 | Barrett et al. | 256/12.5 |
| 5,407,178 | A | | 4/1995 | Long | |
| 5,438,801 | A | * | 8/1995 | Ishihara et al. | 49/357 |
| 5,461,364 | A | | 10/1995 | Sanford, Jr. et al. | |
| 5,662,313 | A | | 9/1997 | Forrester | |
| 6,113,076 | A | | 9/2000 | Hancock-Bogese et al. | |
| 6,199,831 | B1 | | 3/2001 | Patrick et al. | |
| 6,206,347 | B1 | | 3/2001 | Kelley | |
| 6,382,596 | B1 | | 5/2002 | D'Ath | |
| 6,394,688 | B1 | * | 5/2002 | Kraemer | 403/111 |
| 6,880,811 | B2 | * | 4/2005 | Burdick | 256/10 |
| 6,964,080 | B2 | * | 11/2005 | Knauf | 15/250.352 |
| 7,562,453 | B1 | * | 7/2009 | Benner et al. | 29/897.31 |
| 8,042,219 | B2 | * | 10/2011 | Stahlhut | 15/250.352 |
| 2002/0005512 | A1 | | 1/2002 | Trill | |
| 2004/0238807 | A1 | | 12/2004 | Asenbauer | |
| 2006/0186389 | A1 | * | 8/2006 | Stanley | 256/1 |
| 2008/0277638 | A1 | | 11/2008 | Benner et al. | |
| 2009/0293411 | A1 | * | 12/2009 | Benner et al. | 52/741.1 |

FOREIGN PATENT DOCUMENTS

| | | | |
|---|---|---|---|
| KR | 100584667 | B1 | 5/2006 |
| KR | 100732035 | B1 | 6/2007 |
| KR | 20080102582 | A | 11/2008 |

OTHER PUBLICATIONS

International Search Report dated Aug. 20, 2010 in Int'l Application No. PCT/US2010/020326.
Office Action issued May 27, 2010 in U.S. Appl. No. 12/116,797.
Office Action issued Jul. 12, 2005 in U.S. Appl. No. 10/820,207.
Office Action issued Dec. 30, 2005 in U.S. Appl. No. 10/820,207.
Office Action issued Oct. 22, 2013 in GB Application No. GB1111687.8.

* cited by examiner

PIVOTING FENCING APPARATUS AND FENCING SYSTEM

CROSS-REFERENCE TO RELATED APPLICATION

This application is a section 371 of International Application No. PCT/US2010/020326, filed Jan. 7, 2010, which was published in the English language on Jul. 15, 2010 under International Publication No. WO 2010/080880 A2 which claims the benefit of U.S. Provisional Patent Application No. 61/143,034, filed Jan. 7, 2009, the disclosure of which is incorporated herein by reference.

BACKGROUND OF THE INVENTION

The present invention relates to a pivoting barrier fence. In particular, the present invention relates to a pivoting barrier fence that provides a means to prevent climbing animals, such as cats, from climbing over the fence structure.

Many households have pets. In the United States, two of the most common household pets are dogs and cats. No two pets have the same personalities. Some pets can be trained to live outside and not wanderer away from a home or near a street. Other pets are wanderers and will readily get lost if they are left outside and unrestrained.

Dogs are poor climbers, thus any fence that a dog cannot jump over or dig under is typically sufficient to contain a dog within a confined area. However, cats are natural climbers. They also are very adept at leaping. Thus, in order to confine a cat within a fenced area, either a fence has to be constructed that is abnormally high, or some feature has to be added to the fence that deters a cat from climbing over the fence.

In the prior art, there are different types of fences that contain some feature that is intended to prevent the fence from being climbed. Many fences, especially barbed wire fences, have extra runs of barbed wire at the top of the fence to deter people from climbing the fence. However, very few people want to have barbed-wire fences in their backyards to confine their pets.

Another known fence structure uses angled solid panels attached to the top of a chain link fence. The supports for the fence must be significant to support the weight of the angled panels and the wind loads experience by the angled panels. Furthermore, a lot of material is needed to create the angled solid panels. As such, the entire fence assembly is expensive to manufacture and difficult to install. Additionally, the angled solid panels are disposed at the top of the fence. As a consequence, the entire fence assembly is highly visible and blocks the view of whatever may lie beyond the fence.

It is also known to attach a wire shelf to the back of an existing wooden fence. The wire shelf extends horizontally from the fence and therefore acts as a physical barrier. However, while serving as a physical barrier, the horizontally extending wire shelf itself serves as a climbable structure, thus effectively diminishing its ability to act as a barrier to deter climbing animals.

A need therefore exists in the art for a fencing system that can be used to confine a climbing animal, where the fencing system is low cost, easy to install, and reacts to a climbing animal's attempts at climbing over the fencing structure to further deter climbing of the fence. This need is met by the present invention.

BRIEF SUMMARY OF THE INVENTION

In accordance with a preferred embodiment, the present invention provides a fencing apparatus for being secured proximate the top of a conventional fence. The fencing apparatus includes a plurality of first elongated members, a corresponding plurality of second elongated members and a flexible plastic netting. Each of the plurality of first elongated members includes a first end having a mounting bracket and a second end opposite the first end. Each of the plurality of corresponding second elongated members includes a primary end and a secondary end opposite the primary end. Each pair of first and corresponding second elongated members are pivotably attached to one another with a torsion biasing member that biases the first and second elongated members to a first stationary position. In the first stationary position, each pair of first and second elongated members are at a first angle with respect to each other. The corresponding second elongated member is also pivotably movable downwardly from the first stationary position to a second variable position with respect to the first elongated member. The flexible plastic netting is connected to and extends across the plurality of first and corresponding second elongated members.

In accordance with another preferred embodiment, the present invention provides a fencing system that includes a vertically extending fence for enclosing a perimeter having an upper end, and a fencing apparatus connected to the vertically extending fence. The fencing apparatus includes a plurality of first elongated members, a plurality of corresponding second elongated members and a flexible plastic netting. Each of the first elongated members includes a first end having a mounting bracket secured to the vertically extending fence proximate the upper end in a spaced apart relationship and a second end opposite the first end. Each of the plurality of second elongated member includes a primary end and a secondary end opposite the primary end. Each pair of first and corresponding second elongated members are pivotably attached to one another with a torsion biasing member that biases the first and second elongated members to a first stationary position. In the first stationary position, each pair of first and second elongated members are at a first angle with respect to each other. The second elongated member is also pivotably movable downwardly from the first stationary position to a second variable position with respect to the first elongated member. The flexible plastic netting is connected to and extends across the plurality of first elongated members, the corresponding plurality of second elongated members, and a portion of the vertically extending fence.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Reference will now be made in detail to the present embodiments of the invention illustrated in the accompanying drawings. Wherever possible, the same or like reference numbers will be used throughout the drawings to refer to the same or like features. It should be noted that the drawings are in simplified form and are not drawn to precise scale. In reference to the disclosure herein, for purposes of convenience and clarity only, directional terms such as top, bottom, above, below and diagonal, are used with respect to the accompanying drawings. Such directional terms used in conjunction with the following description of the drawings should not be construed to limit the scope of the invention in any manner not explicitly set forth. Unless specifically set forth herein, the terms "a", "an" and "the" are not limited to one element but instead should be read as meaning "at least one". The terminology includes the words noted above, derivatives thereof and words of similar import.

Although the present fencing apparatus and fencing system can be used to confine any non-flying household pet, such as a dog, it is particularly designed to confine climbing pets, such as, but not limited to, cats. Accordingly, when describing the purpose of design for the present invention, it will be described as being used to confine a cat. This is done to present the best mode of use anticipated for the invention.

In a preferred embodiment, the present invention provides a fencing apparatus 10, as shown in FIGS. 1A-9, for being secured proximate the top of a conventional fence. The fencing apparatus 10 includes a plurality of first elongated members 12, a corresponding plurality of second elongated members 14, and a flexible plastic netting 16.

Figure 1A:
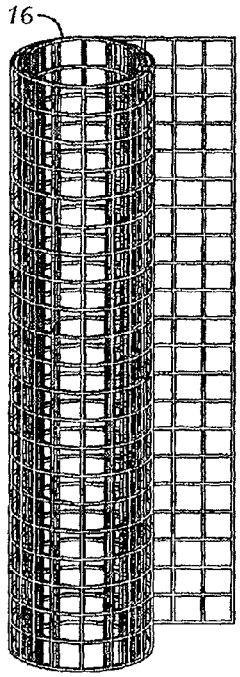
FIG. 1A is a perspective view of a component of a fencing apparatus in accordance with a preferred embodiment of the present invention.
Figure 1B:
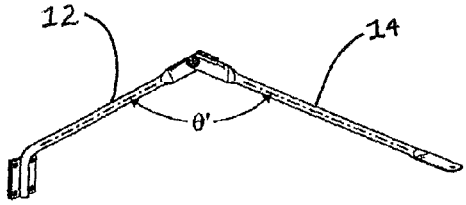
FIG. 1B is a perspective view of another component of the fencing apparatus of FIG. 1A.
Figure 2:
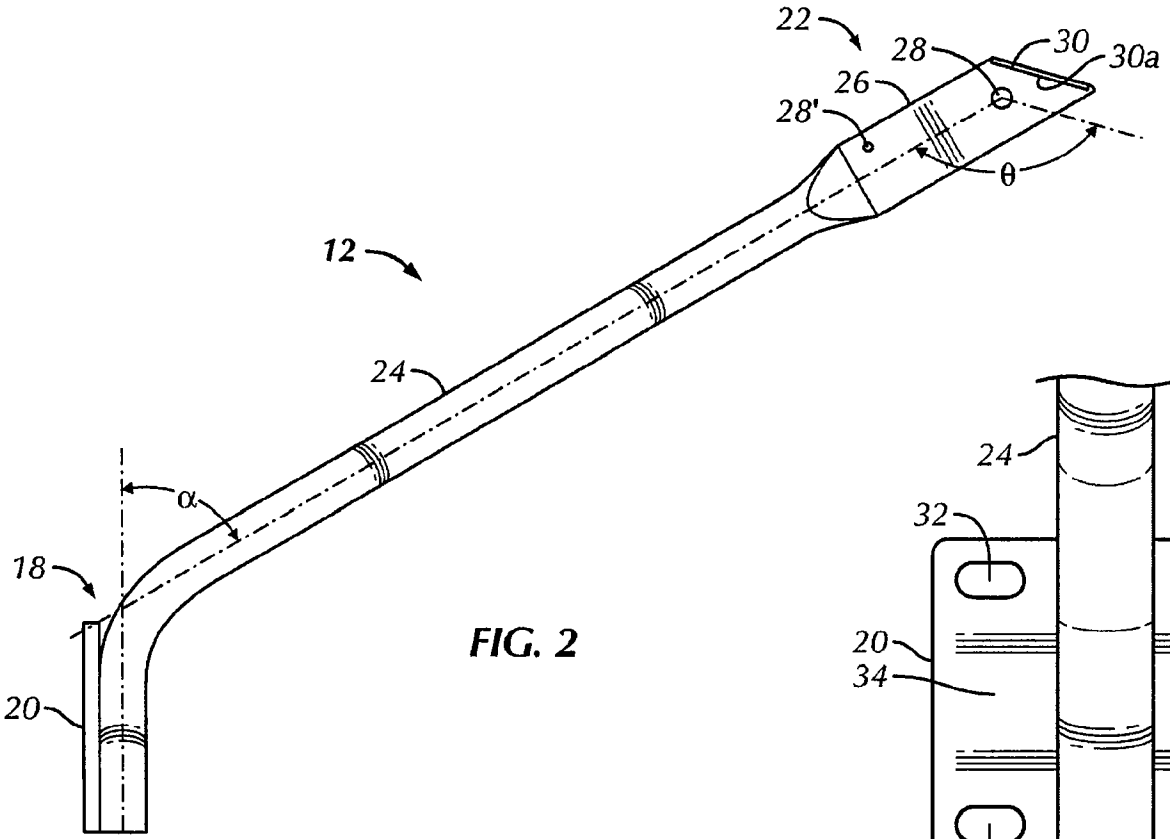
FIG. 2 is a side elevational view of a first elongated member of the fencing apparatus of FIGS. 1A and 1B.

Referring to FIGS. 1B and 2, each of the plurality of first elongated members 12 includes a first end 18 having a mounting bracket 20 and a second end 22 opposite the first end 18. The first elongated member 12 also includes an elongated portion 24 that is preferably configured as a cylindrical member, such as a hollow rod or dowel. A planar end portion 26 is configured about the end of the elongated portion 24 forming the second end 22 of the first elongated member 12. The planar end portion 26 is configured with a first through hole 28 and a secondary through hole 28' that each extends transversely to a longitudinal axis A of the elongated portion 24. The planar end portion 26 also includes a flange 30 that extends perpendicularly to a surface of the planar end portion 26. The flange 30 has a planar surface 30*a* at a first angle θ with respect to the longitudinal axis A. The first angle 0 can be any angle such as an acute or obtuse angle, such that the second elongated member 14 can pivot downwardly relative to the first elongated member 12, as further described below. However, the first angle is preferably about 5 to 175 degrees, about 91 to 179 degrees, about 110 to 160 degrees, and most preferably from about 130 to 140 degrees. In operation, the flange 30 engages the second elongated member 14 to extend the second elongated member 14 at a fixed first stationary position at a second angle 0', as described in more detail hereinafter. The second angle 0' of the first stationary position being defined by the first angle 0 of the flange 30.

Figure 3:
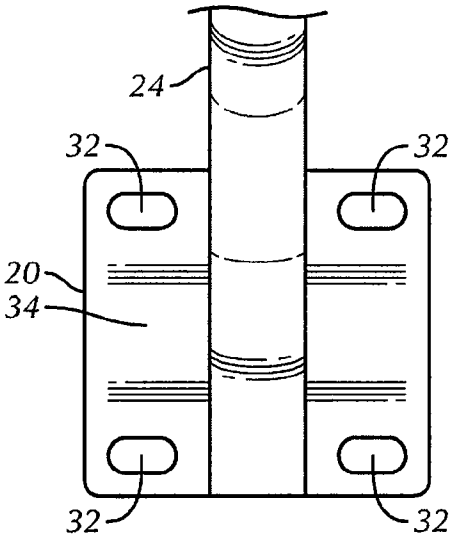
FIG. 3 is an enlarged plan view of a mounting bracket of the fencing apparatus of FIGS. 1A and 1B.

About the first end 18 of each of the plurality of first elongated members 12 is the mounting bracket 20. Preferably, the mounting bracket 20 is configured as a planar mounting bracket 20, as best shown in FIG. 3. The mounting bracket 20 also includes at least one aperture 32, and preferably four apertures 32, for receiving a fastener, such as a screw (not shown), such that the mounting bracket 20 can be securely attached to a conventional vertical fence, such as a wooden fence (FIG. 4) in a spaced apart relationship to another mounting bracket 20. The mounting bracket 20 has a planar surface 34 and the elongated portion 24 of the first elongated member 12 extends from the planar surface 34 at an angle a (FIG. 2) from the planar surface 34. The angle a is preferable an acute angle, more preferably an angle from about 5 to 85 degrees, and most preferably about 30 to 60 degrees. The planar mounting bracket 20 is also orthogonal to the planar end portion 26.

Figure 5:
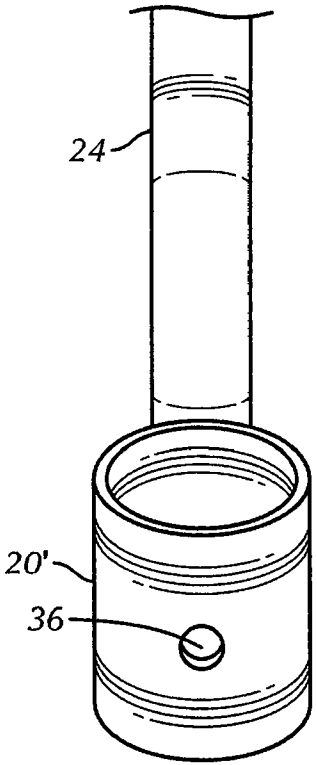
FIG. 5 is an enlarged plan view of another embodiment of a mounting bracket for use with the fencing apparatus of FIGS. 1A and 1B.

In an alternative embodiment, the mounting bracket 20' can be configured as shown in FIG. 5. The mounting bracket 20' is angled similar to that for mounting bracket 20, relative to the elongated portion 24, but configured as a hollow cylindrical mounting bracket 20'. The cylindrical mounting bracket 20' includes at least one aperture 36 that extends transversely to a longitudinal axis of the cylindrical mounting bracket. The aperture 36 is configured to receive a fastener, such as a set screw (not shown) for securing the cylindrical mounting bracket 20' to a cylindrical fence post (not shown) positioned within the hollow cylindrical mounting bracket 20'.

Figure 4:
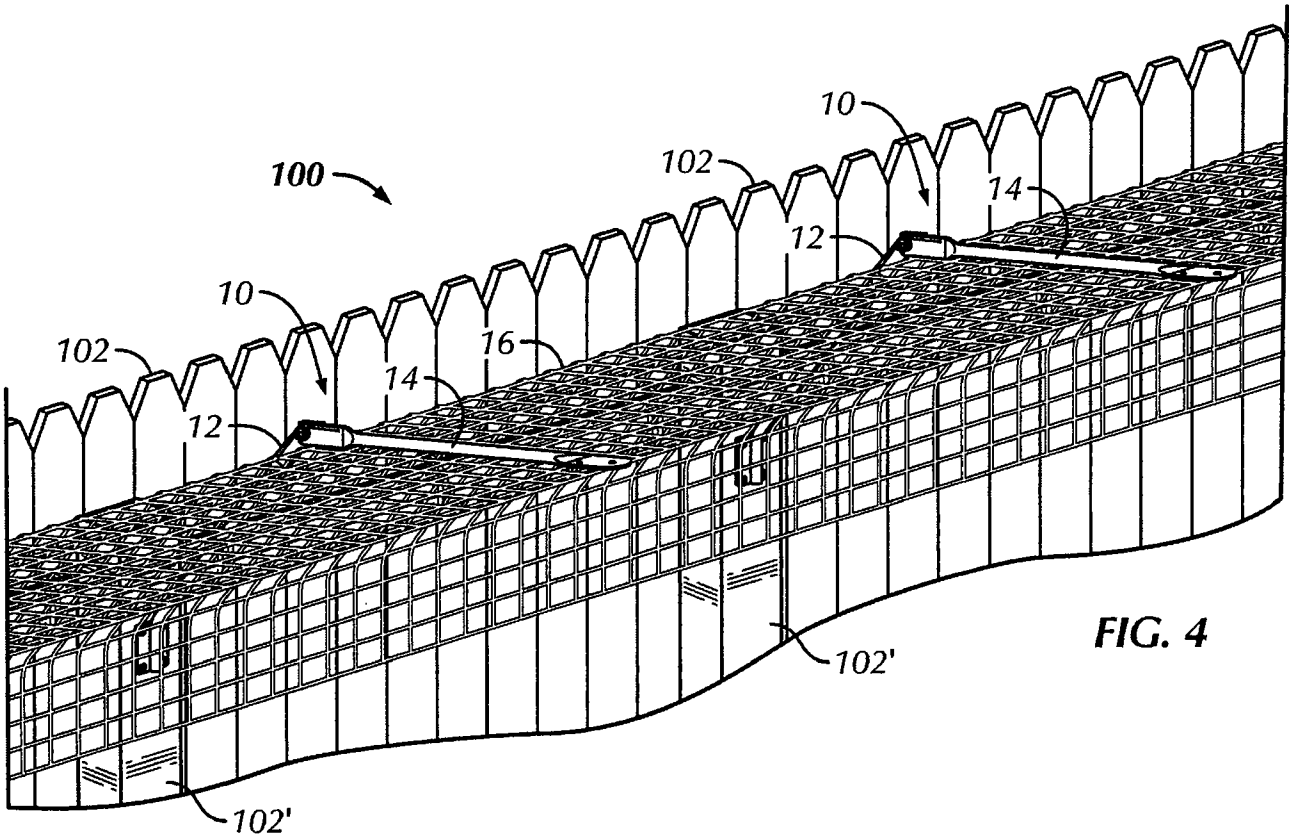
FIG. 4 is a perspective view of the fencing apparatus of FIGS. 1A and 1B assembled to a vertically extending fence.
Figure 6:
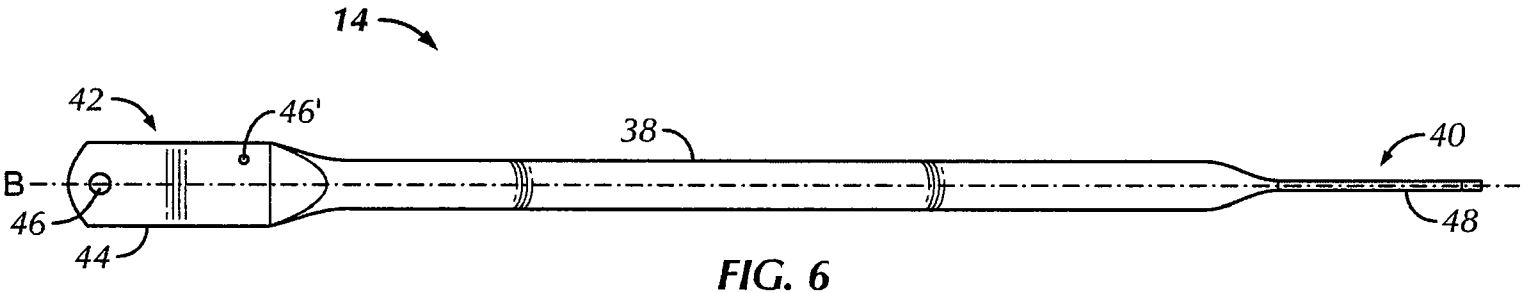
FIG. 6 is a side elevational view of a second elongated member of the fencing apparatus of FIGS. 1A and 1B

The second elongated member 14, is best shown in FIGS. 1B, 4 and 6. Each of the plurality of corresponding second elongated members 14 include an elongated portion 38, a primary end 40, and a secondary end 42. The secondary end 42 is opposite the primary end 40 and pivotably attached to the second end 22 of the first elongated member 12. The elongated portion 38 is preferably configured as a cylindrical member, such as a hollow rod. The secondary end 42 is preferably in the form of a planar end portion 44. The planar end portion 44 includes a first through hole 46 and a secondary through hole 46' that each extends transversely to a longitudinal axis B of the elongated portion 38. Another planar end portion 48 forms the primary end 40. The planar end portion 48 is preferably orthogonal to the planar end portion 44 and can optionally include an aperture (not shown).

Preferably, each of the first elongated members 12 are substantially the same length as the plurality of corresponding second elongated members 14. More preferably, the first and second elongated members 12, 14 are each at least one feet in length. However, it is within the intent and scope of the present invention that the shape and length of each of the first and second elongated members 12, 14 be varied. For example, the elongated members 12, 14 can be configured without end portions that are planar or with end portions of an alternative configuration e.g., spherical. In addition, the second elongated member 14 can be substantially longer than the first elongated member 12, such as a second elongated member 14 that is two, three, four, five, six, seven, eight, nine, or ten times larger than the first elongated member 12.

Figure 7:
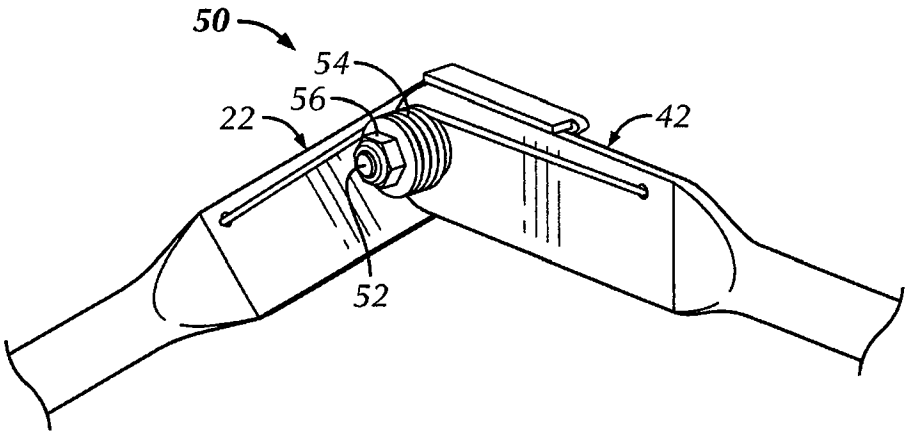
FIG. 7 is a greatly enlarged perspective view of a pivot pin assembly of the fencing apparatus of FIGS. 1A and 1B.
Figure 8:
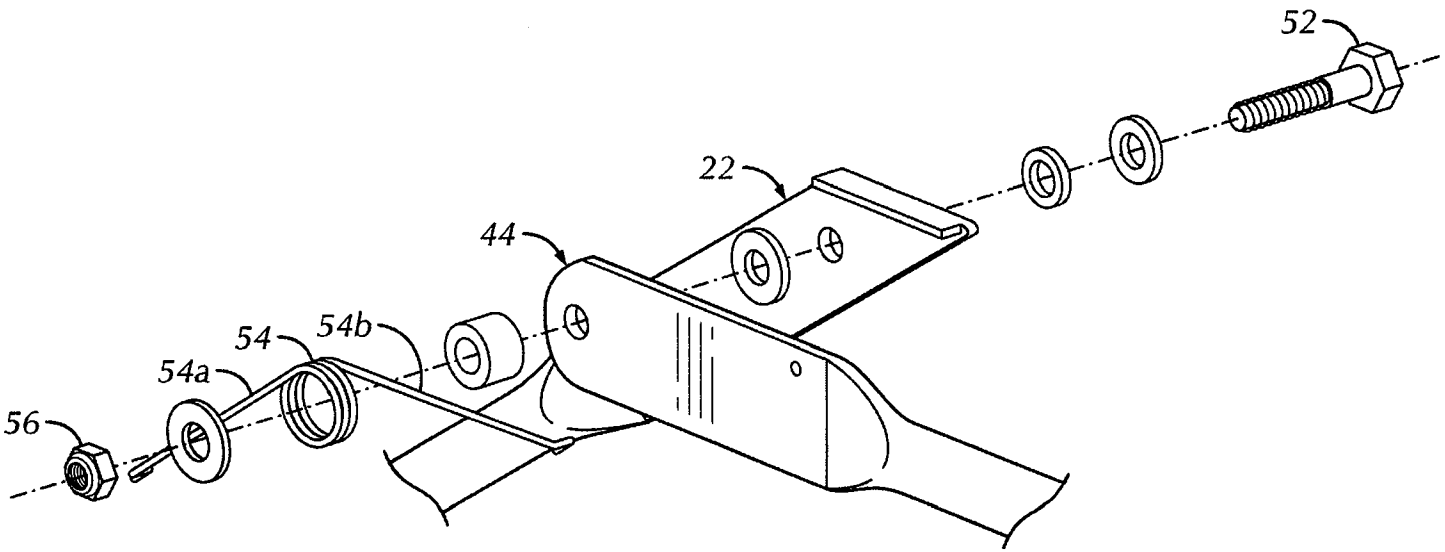
FIG. 8 is an exploded perspective view of the pivot pin assembly of FIG. 7.

Each of the plurality of first and corresponding second elongated members 12 and 14 are pivotably attached to each other via a pivot pin assembly 50, as best shown in FIGS. 7 and 8. While a pivot pin assembly 50 is preferred, it is within the intent and scope of the present invention that any other pivot connection can be used to pivotably connect first and second elongated members, such as, but not limited to, a living hinge, a compression spring hinge, a biasing member, or the like. The pivot pin assembly 50 includes a pivot pin 52 (in the form of a bolt), a torsion biasing member, such as a torsion spring 54, and a self-locking nut 56 for securing the pivot pin 52 to a pair of first and corresponding second elongated members 12 and 14. In the assembled state (FIG. 7), through holes 28 and 46 are aligned such that the pivot pin 52 can extend therethrough. In addition, the torsion spring 54 is aligned such that a longitudinal axis of the coil spring portion 54' is inline with the through holes 28 and 46 and extending wire ends 54*a*, 54*b* extending from the coil spring portion 54' and into the secondary through holes 28' and 46' of the first and second elongated members 12, 14. As such, the pivot pin 52 extends through through holes 28 and 46 and the torsion biasing member 54. Thus, the second elongated member 14 is pivotably movable between the first stationary position and a second variable position with respect to the first elongated member 12. The second variable position being at an angle smaller than the obtuse angle of the first stationary position.

In the assembled state, the torsion spring 54 is under bending stresses such that the torsion spring 54 biases the first and corresponding second elongated member to the first stationary position, in which the first and second elongated members 12, 14 are at an obtuse angle with respect to each other. The torsion biasing member 54 can be any torsion biasing member readily known in the art. Preferably, the torsion biasing member 54 has a rate of about 1 to 15 ft-lb/degree, such that a pair of first and second elongated members 12, 14 will readily pivot under the weight of a relatively small climbing animal, yet remain in the first stationary position when no external load (such as the weight of a small animal) is applied. With the average weight of domesticated felines ranging from about 8 to 11 lbs., the rate of the torsion biasing member 54 is preferably configured to be less than that necessary to support such weights.

Alternatively, the first elongated member 12 can be configured with the elongated portion 24 extending from the mounting bracket 20 at an obtuse angle, such that angle a is about 91 to 179 degrees, preferably from about 110 to 160 degrees and more preferably from about 130 to 140 degrees. When the elongated portion 24 extends from the mounting bracket 20 at such obtuse angles, the first angle CI and pivot pin assembly 50 is correspondingly adjusted such that the second elongated member 14 is configured to pivot downwardly with respect to the first elongated member 12 when attached to a conventional vertically extending fence. In other words, when the fencing apparatus 10 is attached to a conventional fence, the first elongated member 12 can be configured to extend upwardly or downwardly from the fence while the second elongated member 14 is pivotably connected to the first elongated member 12 such that the second elongated member 14 pivots downwardly.

Figure 9:
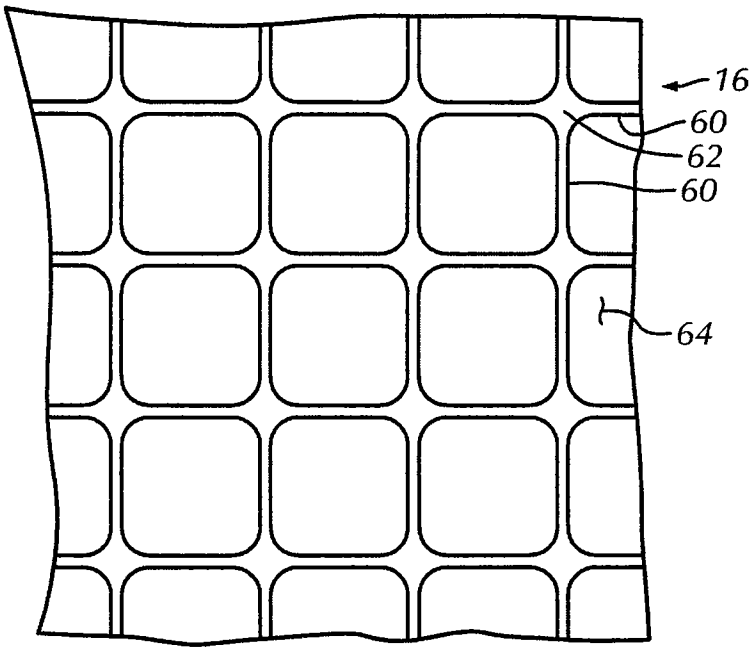
FIG. 9 is fragmentary view of a segment of a flexible plastic netting of the fencing apparatus of FIGS. 1A and 1B.

The flexible plastic netting 16 is connected to and extends across the plurality of first and second elongated members 12, 14. Referring to FIG. 9, it can be seen that the flexible plastic netting 16 is a plastic netting comprised of extruded plastic filaments 60. The plastic filaments 60 are laid out in crisscrossing patterns. The plastic filaments 60 are heat bonded together at intersection points 62 through a standard molding process, therein creating the flexible plastic netting 16. The plastic filaments 60 of the flexible plastic netting 16 intersect at e.g., right angles and create netting with square or diamond shaped net openings 64. The net openings 64 defined by the intersecting plastic filaments 60 are preferably between one inch square and three inches square.

The plastic used in the creation of the flexible plastic netting 16 is preferably either black or dark green. Accordingly, when the flexible plastic netting 16 is suspended, the actual material of the flexible plastic netting 16 is difficult to see. The flexible plastic netting 16 therefore appears to be absent because of its dark coloring and the large disparity between the net openings 64 of the flexible plastic netting 16 and the small diameter plastic filaments 60 that define those net openings 64. Accordingly, the structure of the fencing apparatus 10 provides very little visual obstruction to objects behind the fence.

In addition to being a dark color, the plastic used to create the flexible plastic netting 16 is preferably a plastic polymer, such as polypropylene, polyethylene or poly vinyl chloride, which are resistant to weathering and UV light damage. In this manner, the flexible plastic netting 16 can remain outdoors without rotting, breaking or otherwise degrading. The plastic nature of the flexible plastic netting 16 is also important in that it will not be eaten by deer, rabbits of other animals.

While the flexible plastic netting 16 is the preferred barrier material for the fencing apparatus, it is within the intent and scope of the present invention that any barrier material capable of flexing and suitable for use in accordance with the present invention can be used. Such alternative barrier materials, can for example, include pliable metal meshing or a pliable woven fence.

In accordance with the preferred embodiment, the present invention provides a fencing system 100, as shown in FIG. 4. The fencing system 100 includes a vertically extending fence 102 having an upper end, such as but no limited to a wooden fence, and a fencing apparatus 10, as described above. The vertically extending fence 102 can be any conventional fence for enclosing a perimeter. The fencing apparatus 10 includes a plurality of first and corresponding second elongated members 12, 14 which are secured to the vertically extending fence 102. The mounting bracket 20 of the fencing apparatus 10 is preferably secured to the vertically extending fence 102 proximate the upper end of the fence 102 and more preferably to fence posts 102' of the vertically extending fence 102 by e.g., screws or nails. The flexible plastic netting 16 of the fencing apparatus 10 is connected to and extends across the plurality of first elongated members 12, the plurality of second elongated members 14 and at least a portion of the vertically extending fence 102. The flexible plastic netting 16 also connects to and extends across each of the plurality of first and second elongated members 12, 14. As the second elongated member 14 extends substantially horizontally or is configured to have a horizontally extending direction from the vertically extending fence 102, so does a portion of the flexible plastic netting 16.

Preferably, the flexible plastic netting 16 is connected to the first and second elongated members 12, 14 such that the flexible plastic netting extends across the entirety of an underside of the first and second elongated members 12, 14, as shown in FIG. 4. This configuration of the flexible plastic netting 16 advantageously covers the entirety of the underside of the first and second elongated members 12, 14 such that a climbing animal would not have access to the first or second elongated members 12, 14 for climbing purposes. The flexible plastic netting can be attached to the first and second elongated members 12, 14 by any conventional means, such as fasteners (e.g., common cable ties, wire, tape or string ties), not shown.

The fencing apparatus 10 is also configured to extend inwardly from the vertically extending fence 102 into the perimeter area of the fenced in enclosure. Preferably, the fencing apparatus 10 is configured such that the second elongated member 14 extends substantially horizontally with respect to the vertically extending fence 102. In addition, the first elongated member 12 is connected to the vertically extending fence 102 so as to extend upwardly or in the upwards direction in addition to the second elongated member 14 extending substantially horizontally with respect to the vertically extending fence 102. The fencing apparatus 10 is also preferably connected to the vertically extending fence 102 at a height such that the fencing apparatus 10 is below the top edge of the vertically extending fence 102. In addition, the fencing apparatus 10 is preferably connected the vertically extending fence 102 at a height greater than the height or jump height of a typical small climbing animal, such as three feet. Maintaining the height of the fencing apparatus 10 such that it is below the height of the vertically extending fence 102 allows for the fencing apparatus 10 to be at least partially hidden by the vertically extending fence 102 when viewed externally from the fenced in perimeter.

In operation, when e.g., a cat attempts to climb a fence, it will encounter the fencing apparatus 10. Upon reaching the fencing apparatus 10 and climbing thereon, due to the weight of the cat, the second elongated member 14 will rapidly retract in a downward direction thereby removing any sturdy climbing structure for the cat to climb on. This rapid retraction or pivot of the fencing apparatus 10 causes the cat to release its hold on the fencing apparatus 10. Upon release by the cat, due to the torsion biasing member 54 of the fencing apparatus 10, the second elongated member 14 will extend back into its first stationary position.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A fencing apparatus for being secured proximate the top of a fence, the fencing apparatus comprising:

a plurality of spaced-apart first elongated members that each include a first end having a mounting bracket for being secured to the fence, and a second end opposite the first end, a stop extending outwardly from the second end of each first elongated member;

a corresponding plurality of second elongated members that each include a primary end and a secondary end opposite the primary end, the secondary end of each second elongated member being pivotably attached to the second end of a corresponding first elongated member by a pivot pin;

a torsion spring for each corresponding pair of first and second elongated members, each torsion spring including a central coil surrounding the pivot pin, and first and second wire ends extending from the central coil, the first wire end engaging a first hole in the second end of the first elongated member and the second wire end engaging a second hole in the secondary end of the second elongated member of each pair of pivotally attached first and second elongated members to bias the first and the second elongated members to a first stationary position; and a flexible netting connected to and extending across the plurality of first and second elongated members, wherein when in the first stationary position, each torsion spring biases the respective second elongated member to contact at least a portion of the stop of the respective first elongated member such that the first and the second elongated members extend at a first angle between 5 to 175 degrees with respect to each other, and wherein each second elongated member is pivotably movable downwardly from the first stationary position to a second variable position with respect to the corresponding first elongated member.

2. The fencing apparatus of claim 1, wherein the torsion spring has a rate of about 1 to 15 ft lb/degree.

3. The fencing apparatus of claim 1, wherein each of the plurality of first elongated members is substantially the same length as each of the plurality of second elongated members.

4. The fencing apparatus of claim 1, wherein each second elongated member is at least one foot long.

5. The fencing apparatus of claim 1, wherein the mounting bracket includes at least one aperture.

6. The fencing apparatus of claim 5, wherein the first elongated member extends from the mounting bracket at an angle from about 10 to 80 degrees relative to a planar surface of the mounting bracket.

7. The fencing apparatus of claim 1, wherein each of the plurality of first elongated members and second elongated members are pivotably attached by a pivot pin assembly.

8. The fencing apparatus of claim 7, wherein the pivot pin assembly includes a pivot pin that extends through the first elongated member, the second elongated member, and the torsion spring, the first and second wire ends being spaced-apart from the pivot pin.

9. The fencing apparatus of claim 7, wherein the pivot pin assembly includes a pivot pin that extends through the first elongated member and the second elongated member.

10. A fencing system comprising:

a vertically extending fence for enclosing a perimeter, the vertically extending fence having an upper end; and a fencing apparatus connected to the vertically extending fence, the fencing apparatus comprising:

a plurality of spaced-apart first elongated members that each include a first end having a mounting bracket secured to the vertically extending fence proximate the upper end, a second end opposite the first end, and a stop extending outwardly from the second end;

a corresponding plurality of second elongated members that each include a primary end and a secondary end opposite the primary end, the secondary end of each second elongated member being pivotably attached to the second end of a corresponding first elongated member by a pivot pin;

a torsion spring for each corresponding pair of first and second elongated members, each torsion spring including a central coil surrounding the pivot pin, and first and second wire ends extending from the central coil, the first wire end engaging a first hole in the second end of the first elongated member and the second wire end engaging a second hole in the secondary end of the second elongated member of each pair of pivotally attached first and second elongated members to bias the first and the second elongated members to a first stationary position; and a flexible netting connected to and extending across the plurality of first elongated members, second elongated members, and a portion of the vertically extending fence, wherein when in the first stationary position, each torsion spring biases the respective second elongated member to contact at least a portion of the stop of the respective first elongated member such that the first and the second elongated members extend at a first angle between 5 to 175 degrees with respect to each other, and wherein each second elongated member is pivotably movable downwardly from the first stationary position to a second variable position with respect to the corresponding first elongated member.

11. The fencing system of claim 10, wherein the fencing apparatus extends inwardly from the vertically extending fence into the perimeter and each second elongated member extends substantially horizontally from the vertically extending fence.

12. The fencing system of claim 10, wherein each of the plurality of first elongated member extends upwardly from the vertically extending fence and each of the plurality of the second elongated members extends substantially horizontally from the vertically extending fence.

13. The fencing system of claim 10, wherein the mounting bracket includes at least one aperture.

14. The fencing system of claim 10, wherein the mounting bracket is a cylindrical mounting bracket that includes at least one aperture extending transversely to a longitudinal axis of the cylindrical mounting bracket.

15. The fencing system of claim 10, wherein each of the plurality of first elongated members and second elongated members are pivotably attached by a pivot pin assembly.

16. The fencing system of claim 15, wherein the pivot pin assembly includes a pivot pin that extends through the first elongated member, the second elongated member, and the torsion spring, the first and second wire ends being spaced-apart from the pivot pin.

17. The fencing apparatus of claim 15, wherein the pivot pin assembly includes a pivot pin that extends through the first elongated member and the second elongated member.

* * * * *